US006225913B1

(12) United States Patent
Slomowitz et al.

(10) Patent No.: US 6,225,913 B1
(45) Date of Patent: May 1, 2001

(54) CRIB GATE POSITION INDICATOR

(76) Inventors: Cynthia J. Slomowitz; Scott M. Slomowitz, both of 33 Maple La., Glen Mills, PA (US) 19342

( * ) Notice: Subject to any disclaimer, the term of this patent is extended or adjusted under 35 U.S.C. 154(b) by 0 days.

(21) Appl. No.: 09/383,176

(22) Filed: Aug. 25, 1999

(51) Int. Cl.[7] ..... G08B 21/00

(52) U.S. Cl. ..... 340/686.1; 340/539; 340/573.1

(58) Field of Search ..... 340/521, 539, 340/573.1, 573.4, 686.1, 666, 545.1, 384.1, 384.7, 556; 381/56, 110

(56) References Cited

U.S. PATENT DOCUMENTS

| | | | | |
|---|---|---|---|---|
| 2,734,104 | | 2/1956 | Gollhofer | 200/61.75 |
| 3,641,540 | * | 2/1972 | Cutler et al. | 340/539 |
| 4,231,030 | | 10/1980 | Weiss | 340/686.1 |
| 4,278,968 | | 7/1981 | Arnett et al. | 340/545 |
| 4,924,214 | | 5/1990 | Hill | 340/666 |
| 4,951,032 | * | 8/1990 | Langsam | 340/686.1 |
| 5,057,819 | | 10/1991 | Valenti | 340/513.1 |
| 5,291,181 | | 3/1994 | DePonte | 340/604 |
| 5,365,214 | | 11/1994 | Angott et al. | 340/328 |
| 5,402,105 | | 3/1995 | Doyle et al. | 340/539 |
| 5,499,014 | | 3/1996 | Greenwaldt | 340/539 |
| 5,604,478 | | 2/1997 | Grady et al. | 340/330 |
| 5,629,683 | | 5/1997 | Slomowitz et al. | 340/686.1 |
| 5,689,236 | | 11/1997 | Kister | 340/545 |
| 5,757,274 | | 5/1998 | Slomowitz et al. | 340/573.1 |
| 5,883,579 | | 3/1999 | Schriener et al. | 340/686.1 |
| 5,973,591 | * | 10/1999 | Schwartz et al. | 340/384.7 |

OTHER PUBLICATIONS

New Study on how to avoid crib injuries to infants and toddlers, M. V. Ridenour, Ph.D., Temple, College of Education.

* cited by examiner

*Primary Examiner*—Van T. Trieu
(74) *Attorney, Agent, or Firm*—Caesar, Rivise, Bernstein, Cohen & Pokotilow, Ltd.

(57) ABSTRACT

A crib gate position indicator for use with a baby crib to automatically alert the parent or infant-caretaker, who is at a location outside of the room or location of the baby crib, when the crib gate has been left in an open condition. The apparatus includes crib gate sensor having a transmitter that communicates with a remotely-located indicator, having a receiver, whenever the crib gate is left in an open condition. The remotely-located receiver is plugged into any conventional electrical wall outlet throughout the house and includes either a visual indicator or an audible indicator that provides a warning to the parent or caregiver in the vicinity of the indicator that the crib gate has been left in an open condition.

5 Claims, 4 Drawing Sheets

CRIB GATE POSITION INDICATOR

FIELD OF THE INVENTION

This invention relates generally to indicators and, more particularly, to electronic position indicators for the gate of a crib.

BACKGROUND OF THE INVENTION

Most baby cribs comprise a mattress located within a bed frame having four sides, with each side comprising vertical bars positioned between a top molding and a bottom molding. Two opposing sides are vertically displaceable, known as a crib gate, in either a raised (closed) condition or in a lowered (open) position. Lowering the gate is accomplished by displacing a footbar (located at the bottom and just under the bottom molding) which disengages a bottom molding catch from the footbar and then allows the gate to drop downward. Raising the gate is accomplished by simply lifting the gate upwards until the bottom molding catch re-engages the footbar, thereby locking the gate in a raised position.

In most instances, the parent or infant-caretaker will be holding or rocking the baby to sleep. When the parent or infant-caretaker is ready to place the baby on the mattress, the gate is lowered as discussed previously. Usually, the parent or infant caretaker is so focused on positioning the infant on the mattress without waking the infant that frequently the parent or infant-caretaker forgets to raise the gate after the infant is placed on the mattress. The result is that the infant is left in a crib with the gate down. If the infant is old enough to roll and raise himself/herself, the infant could fall out of the crib at a later time because the crib gate remains in an open condition.

Moreover, a recent study conducted by a Temple University researcher has recommended increasing the side heights of cribs to reduce the number of falls from cribs. If this recommendation is followed, the opening and closing of the crib gate by the parent/caregiver should occur more often since raising the height of the crib sides makes it more difficult to place or lift a toddler from the crib without opening the gate. As a result, this increases the chances that a parenticaregiver may walk away from a crib with the toddler inside and with the crib gate left open.

The following U.S. patents disclose some form of indication or warning in association with a baby crib or bed.

U.S. Pat. No. 2,734,104 (Gollhofer) discloses an alarm for alerting an attendant that the crib gate is in a down position.

U.S. Pat. No. 4,231,030 (Weiss) discloses a safety device for a crib that provides an indicating light or an alarm at the crib to alert a person to the fact that the crib gate is in a down position.

U.S. Pat. No. 4,951,032 (Langsam) discloses a crib rail safety monitor that utilizes a weight sensor for detecting the presence of a child in the crib and an ultrasonic motion detector or infrared temperature sensor for detecting the presence of an attendant at the crib in order to provide an indication or alarm at the crib that the crib gate is down when the child is in the crib and is unattended.

U.S. Pat. No. 5,057,819 (Valenti) discloses a safety cushion device that is positioned on the floor adjacent the baby crib for cushioning the fall of a child and an alarm for alerting an adult of such a fall.

U.S. Pat. No. 5,291,181 (DePonte) discloses a wet bed alarm and temperature monitoring system for detecting urine on the bed and the temperature of a person lying on the bed and for supplying a remote annunciator panel with such information.

U.S. Pat. No. 5,629,683 (Slomowitz et al.), whose entire disclosure is incorporated by reference herein, discloses an automatic crib gate indicator that utilizes a remote-enabling means to enable a crib gate sensor that detects the open condition of the crib gate and then transmits a signal to a remotely located indicator.

U.S. Pat. No. 5,757,274 (Slomowitz et al.), whose entire disclosure is incorporated by reference herein, discloses an automatic crib gate indicator that utilizes a crib gate sensor, for detecting the open condition of the crib gate, that is integrated with a baby monitoring system.

Therefore, there remains a need to provide the parent or infant-caretaker with an automatic remotely-located indication or warning of the crib gate being left in open condition.

OBJECTS OF THE INVENTION

Accordingly, it is the general object of this invention to provide a crib gate position indicator that overcomes the disadvantages of the prior art.

It is a further object of this invention to provide a crib gate position indicator that automatically informs the parent or infant-cretaker that the crib gate is open.

It is yet a further object of this invention to provide a crib gate position indication to a parent or infant-caretaker at a location outside the room of the crib.

It is a further object of one aspect of this invention to provide a crib gate position indicator that generates a gate open indication without the need for the parent or infant-caretaker to manually enable/disable some indication apparatus.

It is yet another object of this invention to provide a crib gate position indicator that is easy to install on existing cribs.

It is still a further object of this invention to provide a crib gate position indicator that has no wires within reach of the infant when the infant is in the crib.

SUMMARY OF THE INVENTION

These and other objects of the instant invention are achieved by providing an apparatus for providing an automatic crib gate position indication of a crib having a gate that can be positioned in an open or a closed condition. The apparatus comprises a gate sensor which comprises a power source, a transmitter for wirelessly transmitting a signal when electrically coupled to the power source, and a switch coupled to the gate and electrically coupled between the power source and the transmitter. The switch electrically couples the power source to the transmitter whenever the gate is in an open condition. The apparatus further comprises a remotely-located indicator that comprises a receiver and an indication means whereby the receiver receives the signal and activates the indication means to alert someone in the vicinity of the remotely-located indicator that the crib gate is in an open condition.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
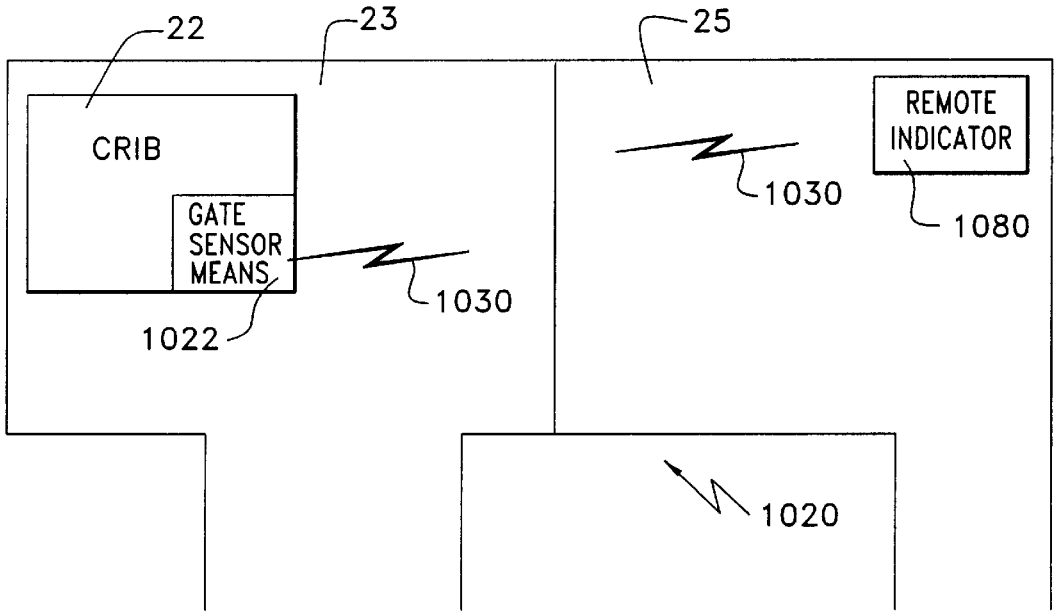
FIG. 1 is a top plan view of a home showing the location of the present invention.

Referring now in greater detail to the various figures of the drawing wherein like reference characters refer to like parts, there is shown generally at 1020 in FIG. 1, a crib gate position indicator constructed in accordance with this invention.

Figure 2:
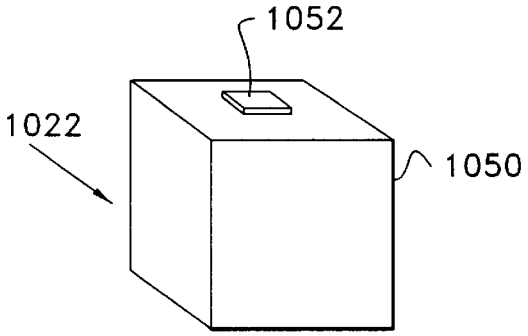
FIG. 2 is an enlarged isometric view of the gate sensor shown in FIG. 1.
Figure 4:
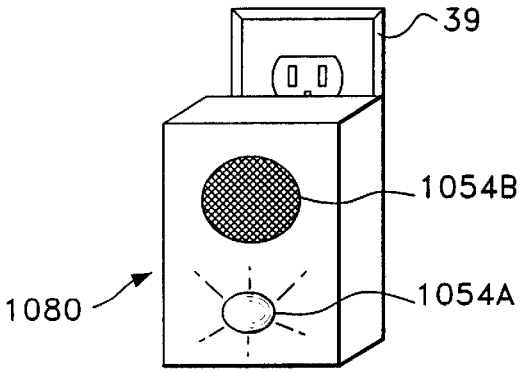
FIG. 4 is an isometric view of the remotely-located indicator electrically-coupled to an electric wall outlet and showing either a visual indicator or an audible indicator.
Figure 3:
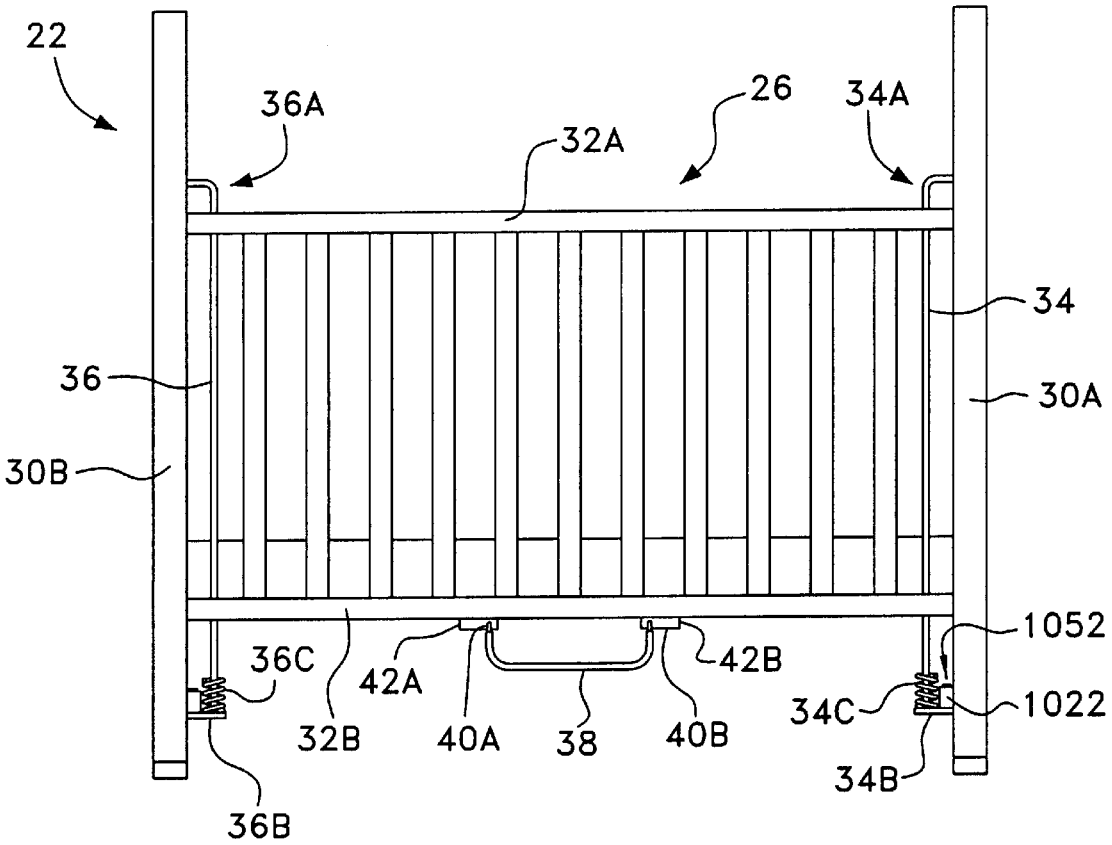
FIG. 3 is a side view of the crib with the gate sensor coupled thereto.

The crib gate position indicator 1020 comprises a gate sensor 1022 (FIG. 2) coupled to a crib 22 having a crib gate 26 (FIG. 3) and a remotely-located indicator 1080 (FIG. 4) which comprises either a visual indicator 1054A or an audible indicator 1054B. Operation of the crib 22 is discussed in U.S. Pat. No. 5,629,683 (Slomowitz et al.), whose entire disclosure is incorporated by reference herein, and is therefore not repeated here. The remotely-located indicator 1080 is located in another room 25, e.g., the parent's bedroom, not necessarily adjacent the baby's room 23 and, in fact, can be any room where an electrical wall (or power strip, not shown) outlet 39 is available. Thus, the crib gate position indicator 1020 provides for the remote indication (i.e., outside of the baby's room 23) of the open position of the crib gate 26.

Figure 5:
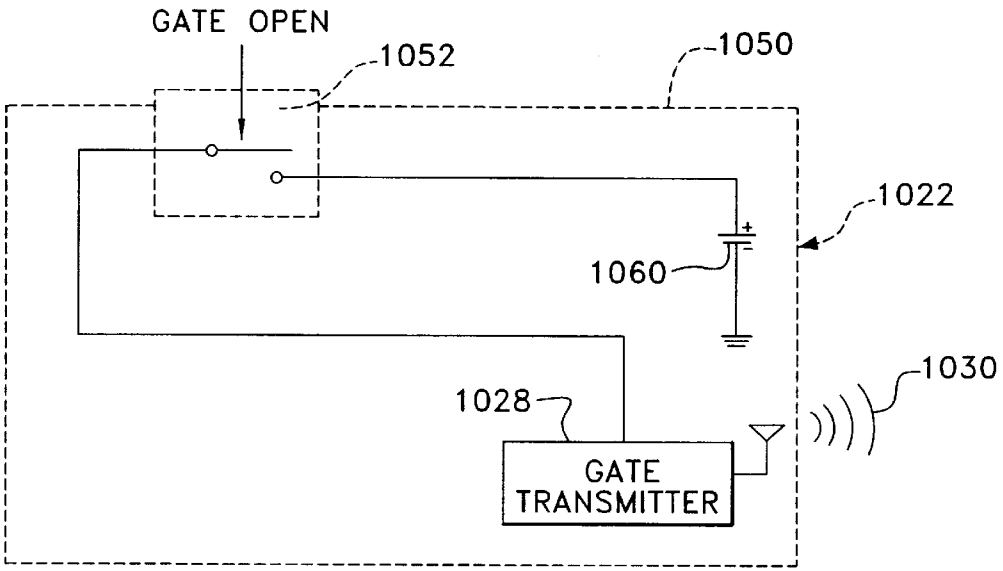
FIG. 5 is a block diagram/schematic of the gate sensor.

As shown in FIG. 5, the gate sensor 1022 comprises a housing 1050 having a crib gate switch 1052 (e.g., a C&K® 8168J81ZGE22 SPDT switch or proximity switch) located on the top surface of the housing 1050. The bottom surface of the housing 1050 includes a fastening means (e.g., a Velcro fastening tape, magnet, screw, clasp, etc.) for securement of the housing 1050 to one of the crib support plates 34B or 36B. Activation of the crib gate switch 1052 is caused by the lower molding 32B of the crib gate 26 depressing the switch 1052 when the gate 26 is in the "down" (open) condition. Conversely, raising (cdosing) the gate 26 de-activates the crib gate switch 1052. When the crib gate 26 depresses the switch 1052, a power source (e.g., a 9VDC battery) 1060 is electrically coupled to a gate transmitter 1028 (e.g., Linear Alert Receiver Model No. D-8C and associated transmitter), thereby activating the gate transmitter 1028 to emit a "crib gate down" signal 1030 to the remotely-located indicator 1080.

It should be understood that the switch 1052 is by way of example only and that any similar or equivalent means for detecting the open position of the gate 26 (e.g., a proximity switch, a magnetically-mupled sensor, Hall effect sensor, etc. such as those shown in U.S. Pat. No. 4,278,968 (Amett et al.); U.S. Pat. No. 5,365,214 (Angott et al.); U.S. Pat. No. 5,499,014 (Greenwaldt); and U.S. Pat. No. 5,689,236 (Kister), all of whose disclosures are incorporated by reference herein) and then for electronically coupling the gate transmitter 1028 to the power source 1060 when the crib gate 26 is in the open condition, is covered by the scope of the switch 1052.

Furthermore, it should also be understood that, although not shown, it is within the broadest scope of the invention to include a gate sensor 1022 that is integral with the crib 22, i.e., the gate sensor 1022 can either be coupled to an existing crib 22 or can be integral with the crib 22 frame.

Figure 6:
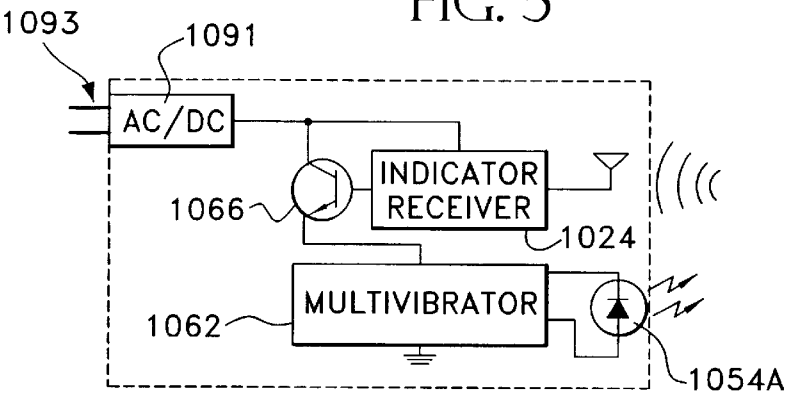
FIG. 6 is block diagram of the remotely-located indicator utilizing a visual indicator.
Figure 7:
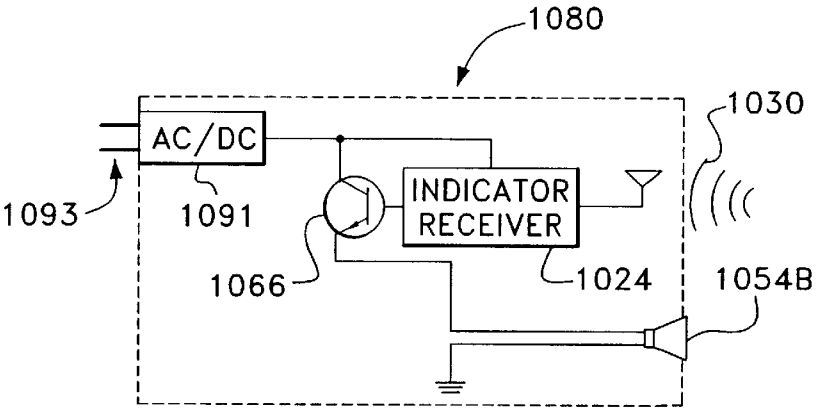
FIG. 7 is a block diagram of the remotely-located indicator utilizing an audible indicator.

The remotely-located indicator 1080 comprises a visual indication means 1054A (FIG. 6,. e.g., a light emitting diode-Panasonic LN28RP, a light bulb or any type of illuminator), or an audible indication means 1054B (FIG. 7, e.g., Panasonic EFB-CB37C11 Ceramic Buzzer). The remotely-located indicator 1080 further comprises an indicator receiver 1024 (e.g., Linear Alert Receiver Model No. D-8C) that is coupled to the base of a transistor 1066 and whose emitter is coupled to a multivibrator 1062 which in turn is coupled to ground; the collector of the transistor 1066 is coupled to the power source, e.g., DC voltage provided by an AC/DC converter 1091. The remotely-located indicator 1080 further comprises a conventional plug 1093 that permits the indicator 1080 to be plugged into any electrical wall outlet 39 throughout the home. The output of the multivibrator 1062 is coupled to the visual indication means 1054A; if the audible indication means 1054B is used, the emitter of the transistor 1066 is coupled directly to the audible indication means 1054B.

Operation of the apparatus 1020 is as follows. When the crib gate 26 is opened, the switch 1052 of the gate sensor 1022 activates the gate transmitter 1028 which transmits the signal 1030. The signal 1030 is received by the indicator receiver 1024 which then turns on the transistor 1066 which in turn activates the multivibrator 1062. This causes the visual indicator means 1054A to flash, thereby warning the parent or caregiver in view of the remotely-located indicator 1080 to go to the crib 22 and close the gate 26. Once the gate 26 is cdosed, the switch 1052 is opened and the gate transmitter 1028 de-activated. Furthermore, to avoid depleting the power source 1060 in the gate sensor 1022 when, for example, the toddler or infant is being removed in the morning, the parentlcaregiver should close the crib gate 26, thereby opening the switch 1052 until the toddler or infant is placed back in the crib 22.

Alternatively, if the audible indication means 1054B is used, the turning on of the transistor 1066 causes the audible indication means 1054B to emit an audible signal (e.g. a humming, a whistle, a statement, a tune, etc.) that can be heard by the parent or caregiver causing them to again corrective action, i.e., close the crib gate 26. Once the gate 26 is dosed, the switch 1052 is opened and the gate transmitter 1028 de-activated.

It should be understood that the multivibrator 1062 could be coupled between the transistor 1066 and the audible indication means 1 054B to cause a wavering sound for the audible signal.

Although not shown, the remotely-located indicator 1080 may comprise a portable unit, comprising its own power source (e.g., a 9VDC battery), with the transistor 1066 driving a tactile means (e.g., SU 020S-09170 vibrator device). Thus, when the indicator receiver 1024 receives the emitted signal 1030, the receiver 1024 turns on the transistor 1066 which activates the tactile means which is felt by the parent or caregiver who is wearing (e.g., on the wrist or waist) the portable indicator means.

As disclosed in both U.S. Pat. No. 5,629,683 (Slomowitz et al.) and U.S. Pat. No. 5,757,274 (Slomowitz et al.), the emitted signal 1030 may comprise a signal in the 900 MHz range or above where low power, wireless transmission is permitted for home use.

Figure 8:
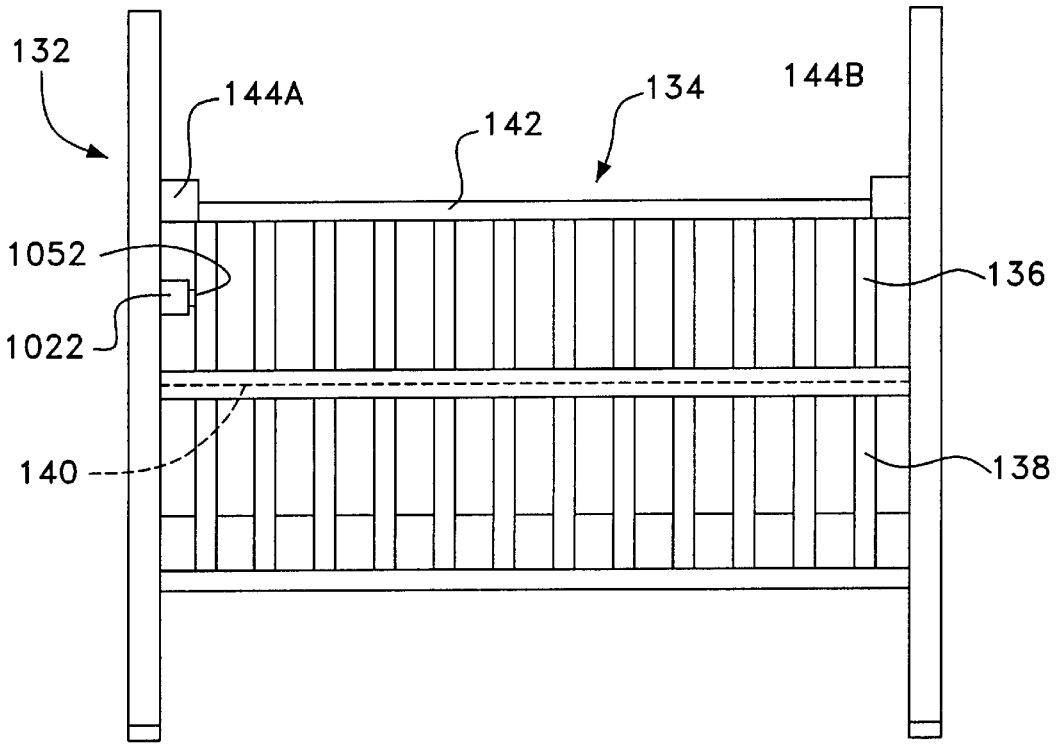
FIG. 8 is a side view of another conventional crib having a rotating gate and having a gate sensor coupled thereto.

It should be noted that is also within the broadest aspect of this invention to have the gate sensor 1022 be compatible with a variety of displaceable gate cribs. For example, there is shown in FIG. 8, a Gerry Wood Products, Inc. Model 85 crib 132 having a crib gate 134 that has a rotatable upper portion 136 and fixed lower portion 138. In particular, the upper portion 136 rotates about an axis 140 towards the crib interior (into the plane of the paper in FIG. 8), thereby opening the gate 134. The ends of the upper molding 142 are releasably press-fit into catches 144A and 144B by the parent or infant-caretaker to dose the gate 134. Pressure on the upper molding 142 towards the crib interior disengages the ends of the upper molding 142 from the catches 144A and 144B, thereby opening the gate 134. FIG. 8 depicts the crib gate 134 in a closed condition.

The gate sensor 1052 can be coupled to the crib 132 to detect the "open" condition of the upper portion 136. To operate properly, though, the switch 1052 would be reversed, i.e., the switch 1052 depicted in FIG. 4 would be open (i.e., the power source 1060 and the gate transmitter 1024 would be de-coupled) whenever the upper portion 136 were dosed; conversely, when the upper portion 136 were open, the switch 1052 would be dosed, thereby coupling the power source 1060 to the gate transmitter 1028 to emit the signal 1030.

Without further elaboration, the foregoing will so fully illustrate our invention that others may, by applying current or future knowledge, readily adopt the same for use under various conditions of service.

We claim:

1. An apparatus for providing an automatic crib gate position indication of a crib having a gate that can be positioned in an open or a closed condition, said apparatus comprising:

(a) a non-intrusive gate sensor that is positioned out of reach of an infant or toddler who is placed in the crib, said gate sensor comprising:

(1) a power source;

(2) a transmitter for wirelessly transmitting a signal when electrically coupled to said power source; and (3) a switch coupled to the gate and electrically coupled between said power source and said transmitter, said switch electrically coupling said power source to said transmitter whenever the gate is in an open condition; and (b) a remotely-located indicator comprising a receiver and an indication means, said receiver receiving said signal and activating said indication means to alert someone in the vicinity of said remotely-located indicator that the crib gate is in an open condition.

2. The apparatus of claim 1 wherein said indication means is a visual indicator.

3. The apparatus of claim 1 wherein said indication means is an audible indicator.

4. The apparatus of claim 1 wherein said remotely-located indicator further comprises AC/DC conversion circuitry and electrical plug for insertion into a conventional electrical wall outlet.

5. The apparatus of claim 1 wherein said switch comprises a non-contact sensor that detects the open condition of the gate and electrically couples said power source to said transmitter.

* * * * *

UNITED STATES PATENT AND TRADEMARK OFFICE

CERTIFICATE OF CORRECTION

PATENT NO. : 6,225,913 B1 
DATED : May 1, 2001
INVENTOR(S) : Cynthia J. Slomowitz and Scott M. Slomowitz It is certified that error appears in the above-identified patent and that said Letters Patent is hereby corrected as shown below:

Column 3,
Line 59, replace the word "mupled" with -- coupled --.

Signed and Sealed this

Eleventh Day of November, 2003

JAMES E. ROGAN
*Director of the United States Patent and Trademark Office*